US008746715B2

(12) United States Patent
Woncik

(10) Patent No.: US 8,746,715 B2
(45) Date of Patent: Jun. 10, 2014

(54) FOLDING SKATEBOARD

(75) Inventor: John Woncik, Granada Hills, CA (US)

(73) Assignee: John Woncik

( * ) Notice: Subject to any disclaimer, the term of this patent is extended or adjusted under 35 U.S.C. 154(b) by 235 days.

(21) Appl. No.: 13/053,948

(22) Filed: Mar. 22, 2011

(65) Prior Publication Data

US 2011/0236607 A1 Sep. 29, 2011

Related U.S. Application Data

(60) Provisional application No. 61/317,518, filed on Mar. 25, 2010.

(51) Int. Cl.
*A63C 17/01* (2006.01)

(52) U.S. Cl.
USPC ..... 280/87.042

(58) Field of Classification Search
USPC ..... 280/87.042
See application file for complete search history.

(56) References Cited

U.S. PATENT DOCUMENTS

| | | | | |
|---|---|---|---|---|
| 6,131,931 | A * | 10/2000 | Globerson et al. | 280/87.042 |
| D505,470 | S * | 5/2005 | Hong | D21/765 |
| 2006/0119062 | A1 * | 6/2006 | Lukoszek | 280/87.042 |
| 2007/0035101 | A1 * | 2/2007 | Gregory et al. | 280/87.042 |

* cited by examiner

*Primary Examiner* — Jeffrey J Restifo
*Assistant Examiner* — Erez Gurari
(74) *Attorney, Agent, or Firm* — John Woncik

(57) ABSTRACT

A folding skateboard may include a first board piece, a second board piece and a third board piece. The first board piece and third board piece may be secured to the second board piece with first and second sets of hinges. The board pieces may include an outer rail disposed on the outer edges of the board pieces that can slide along the outer edges of the board pieces in an unfolded configuration. The outer rails may lock in place to allow the folding skateboard to remain in a rigid unfolded configuration or allow the board to be folded into a three-layered configuration for storage. The trucks of the folding skateboard may be easily secured to and removed from the first and third board pieces.

7 Claims, 6 Drawing Sheets

FOLDING SKATEBOARD

CROSS-REFERENCE TO RELATED APPLICATION

The present application claims the benefit under 35 U.S.C. §119(e) of U.S. Provisional Application No. 61/317,518, filed Mar. 25, 2010, which is incorporated herein by reference.

BACKGROUND OF THE INVENTION

The present invention is generally related to a skateboard that can be folded onto itself for easy storage and transportation when not in use.

Generally, skateboards that are between about 36" to 60" long are called longboards. Longboards are intended for travel and recreational cruising, and not for rough tricks performed on standard skateboards that are 32" and under. Due to their size and length, longboards may be difficult to store or secure and many schools may not allow longboards on campus for this reason.

As can be seen there is a need for a longboard skateboard that can be folded and/or collapsed to allow for easier storage and transportation when not in use.

SUMMARY OF THE INVENTION

In one aspect of the present invention, a skateboard is provided that includes a board deck having a first board piece, a second board piece and a third board piece, a first hinge set connecting the first board piece to the second board piece, and a second hinge set connecting the second board piece to the third board piece.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a folding skateboard.

Figure 1:
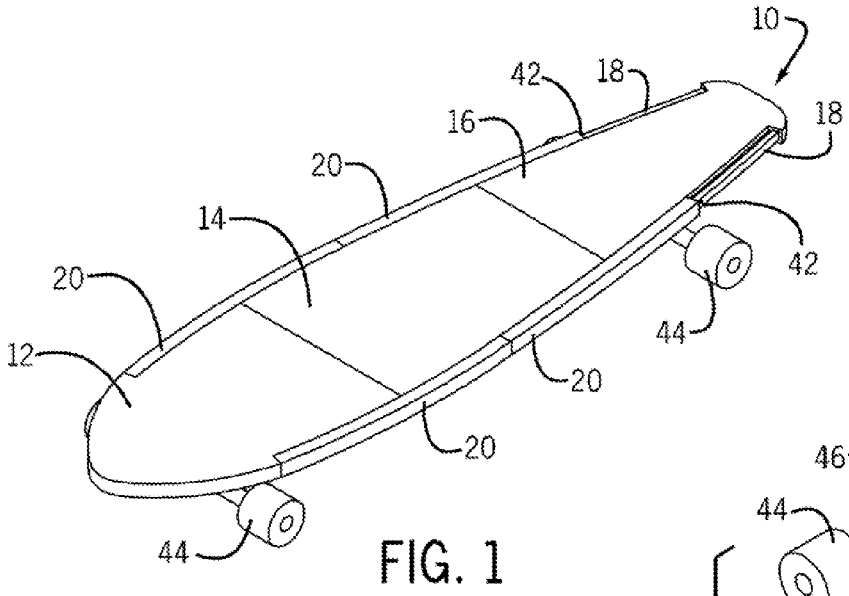
FIG. 1 illustrates a perspective view of one embodiment of an assembled folding skateboard according to the present invention.
Figure 2:
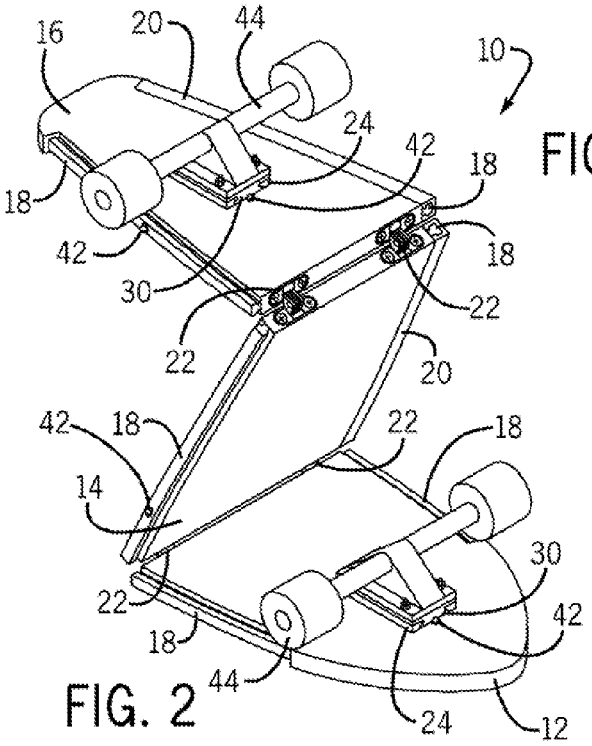
FIG. 2 illustrates a perspective view of the skateboard of FIG. 1 being folded.

FIG. 1 illustrates an exemplary embodiment of a folding skateboard 10 according to an exemplary embodiment of the present invention in an assembled state. One embodiment of the folding skateboard may be about ½" thick, about 9" wide, and about 45" long when unfolded and assembled. As illustrated in FIG. 2, the folding skateboard can fold in a hinged Z-shaped manner to form a three-layered configuration, for example, with dimensions of about 1¾" thick, about 9" wide and about 15" long.

One embodiment of the folding skateboard 10 may include a front board piece 12, a middle board piece 14 and a rear board piece 16. The front board piece 12 and rear board piece 16 may be secured to the middle board piece 14 using hinges 22 that allow the board pieces 12, 14, and 16 to sit flush against each other in an unfolded position. For example, Soss™ brand invisible hinges 22 can be used, as they are tamper-proof and cannot be seen when the longboard is unfolded flat at 9"×45". When in a folded position, the hinges 22 allow the skateboard 10 to fold into a stacked three-layer configuration. Each of the board pieces 12, 14 and 16 may be made from a sturdy material that can be about ½" thick and suitable for skateboards and/or longboards such as plywood, for example.

Figure 3:
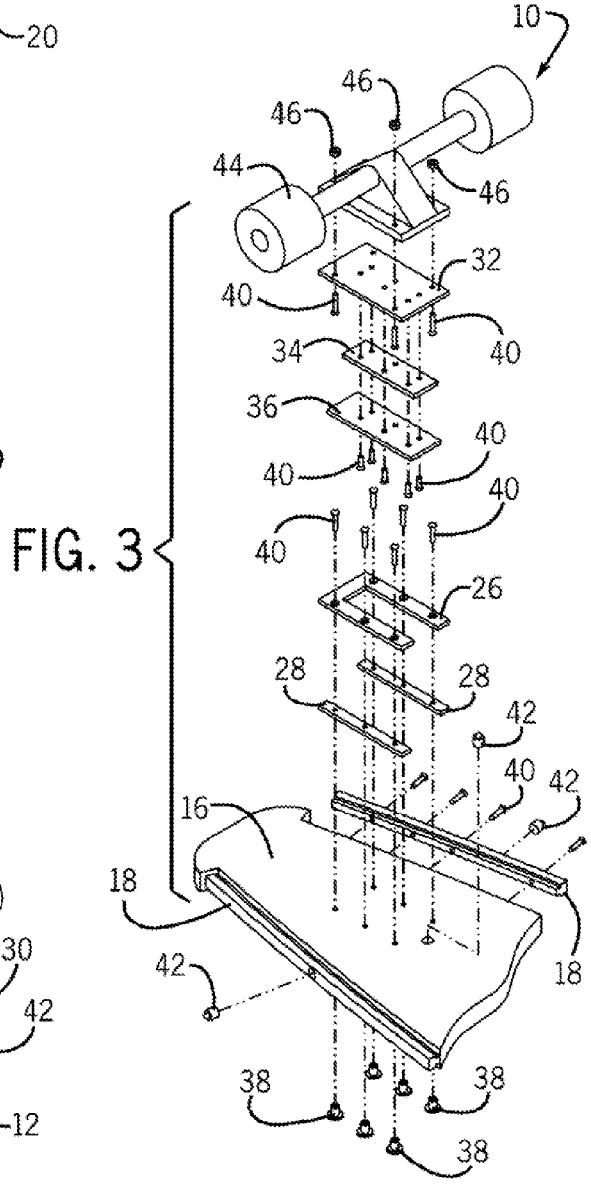
FIG. 3 is a detailed exploded perspective view illustrating one embodiment of a board and truck assembly.

One embodiment of the folding skateboard 10 may include wheels and bases, called trucks 44, that can be quickly unlocked and removed without the use of any tools. This may be achieved by using a truck shoe that can slide into a deck shoe and lock in place. FIG. 3 illustrates one embodiment of a truck shoe assembly 30 that may be pre-mounted onto trucks 44. This embodiment of the truck shoe assembly 30 may be screwed to the trucks 44 using e.g., ⅛" aluminum plates, e.g., a 2½" by 3¼" truck shoe upper plate 32, 1" by 2½" middle plate 34, and 1¼" by 3¼" lower plate. Any brand of skateboard truck 44 can be bolted to the truck shoe's four hole upper plate 30, with counter sink screws 40 and nuts 46.

The truck shoes 30 can be male-type truck shoes that can slide and lock into female-type deck shoes 24, e.g., a 2½" by 3¼" horse-shoe shaped upper plate 26 and two ½" by 3¼" deck shoe lower plates 26 and 28, which can fasten to the board pieces 12 and 16 with, e.g., T-nut type nuts 38 and countersink screws 40.

Figure 14:
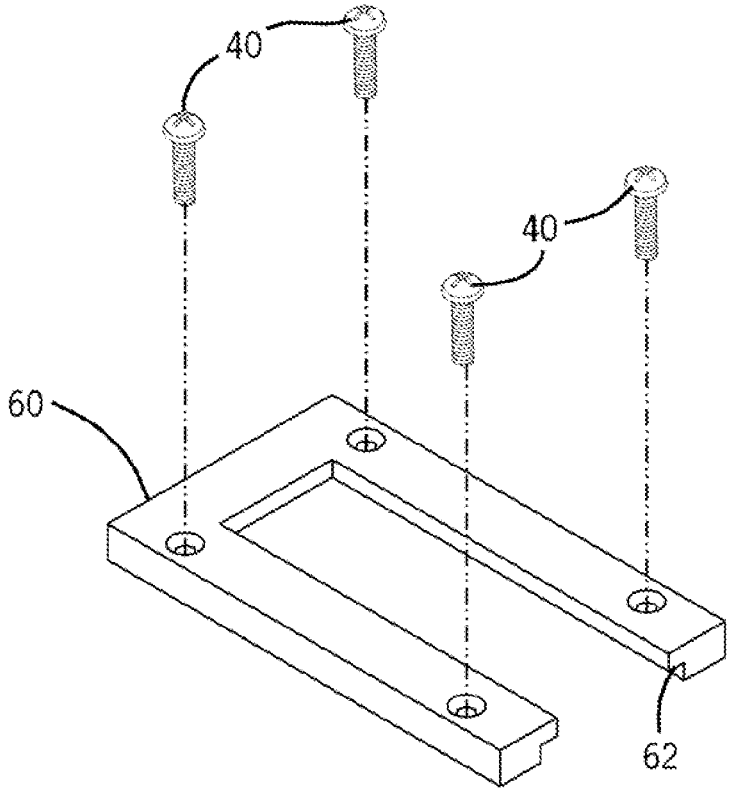
FIG. 14 illustrates an alternate embodiment of a deck shoe.
Figure 15:
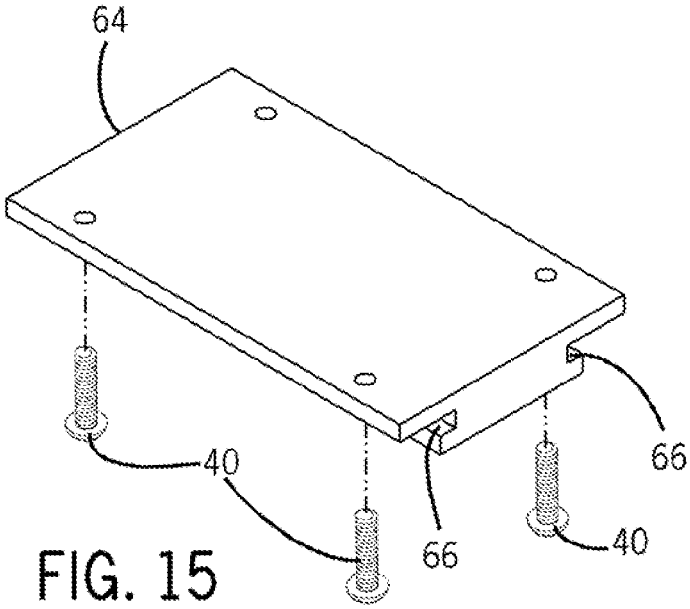
FIG. 15 illustrates an alternate embodiment of a truck shoe.
Figure 16:
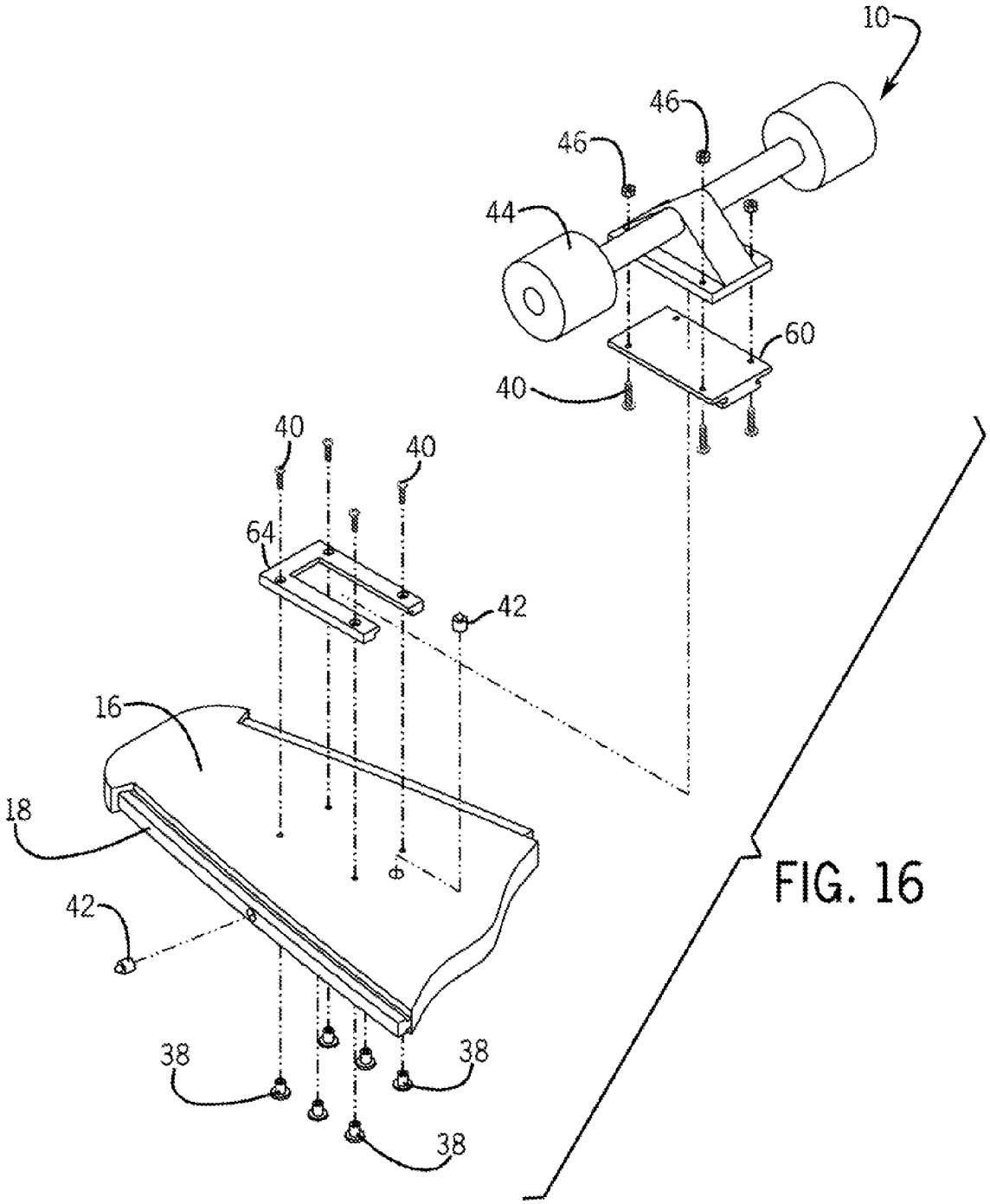
FIG. 16 is a detailed exploded perspective view illustrating another embodiment of a board and truck assembly using the truck and deck shoes of FIG. 14 and FIG. 15.

Other embodiments of the truck shoes and deck shoes may be machined using a solid piece of aluminum that may be about ⅜" thick. FIG. 14 illustrates such a deck shoe 60 having a machined relief 62 to form a female-type deck shoe 60. FIG. 15 illustrates a solid male-type truck shoe 64. As illustrated in FIG. 16, both the deck shoes 60 and truck shoes 64 may be secured to the board pieces 12 and 16 and trucks 44, respectively, using counter sink screws 40 and nuts 46 and/or T-nut type nuts 38.

Figure 7:
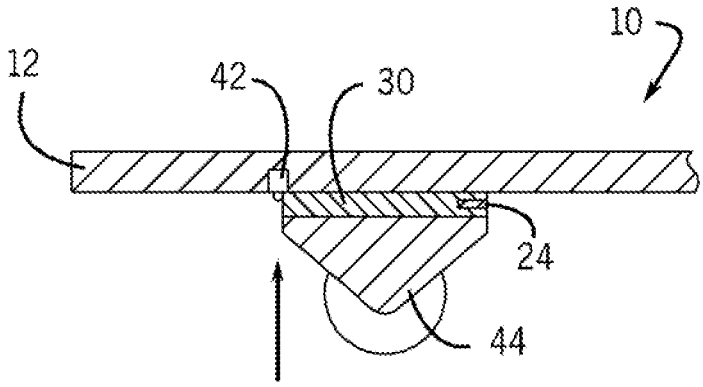
FIG. 7 is a cross-sectional view of the skateboard taken along the line 7-7 of FIG. 4.
Figure 8:
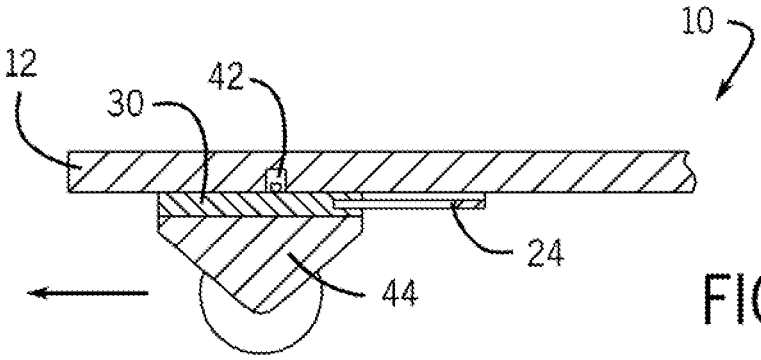
FIG. 8 is a cross-sectional view of the skateboard of FIG. 4 illustrating the disassembly of the truck and board.
Figure 9:
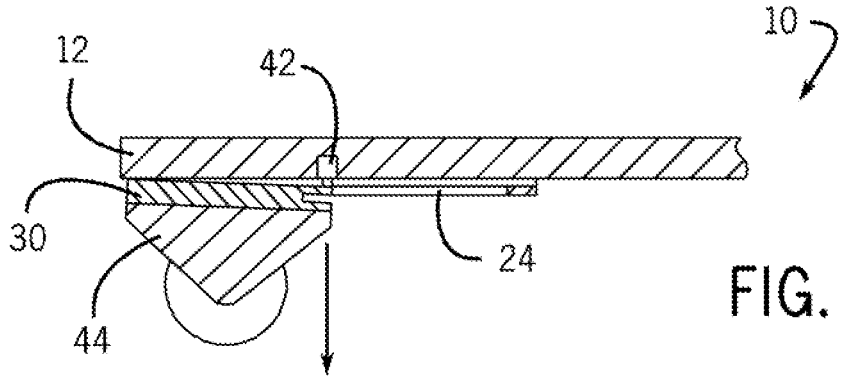
FIG. 9 is a cross-section view of the skateboard of FIG. 4 illustrating the disassembled truck and board.

To lock a truck shoe to a deck shoe, some embodiments may use a spring-loaded bullet catch 42 that may be disposed in the deck. For example, the truck shoe 30 can push down on the spring-loaded bullet catch located in front of the deck shoe assembly 24. After compressing the bullet catch 42 down, the deck shoe assembly 24 can be set flat against the deck and can slide backwards, e.g. 3¼", into the deck shoe assembly 24. The spring loaded bullet catch 42 can pop up into place locking the truck shoe 30 securely into the deck shoe assembly 24 once in place. The truck and wheel assembly 44 can be removed from the deck in the opposite fashion as illustrated in FIG. 7-FIG. 9.

Figure 4:
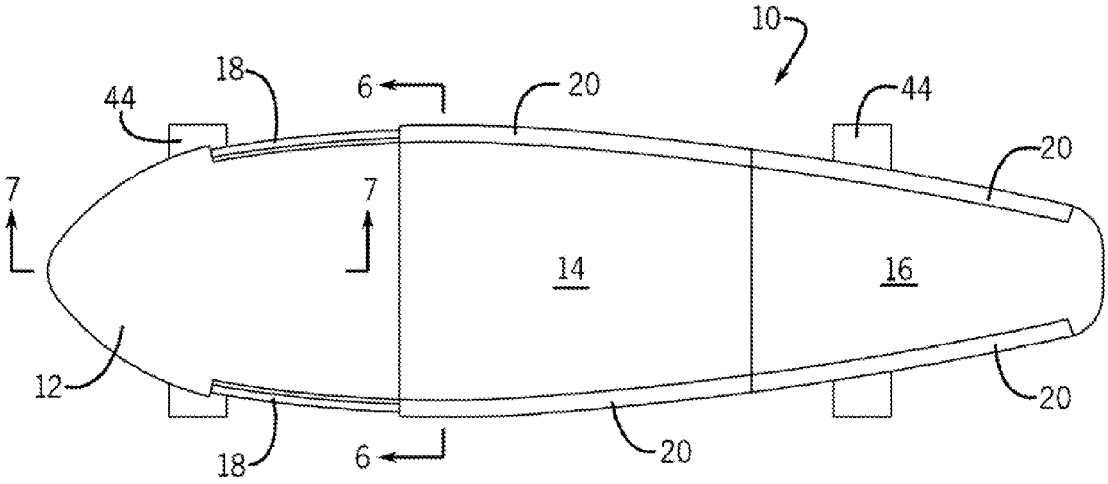
FIG. 4 is a top view of the skateboard of FIG. 1 illustrating a starting position of outer rails.
Figure 5:
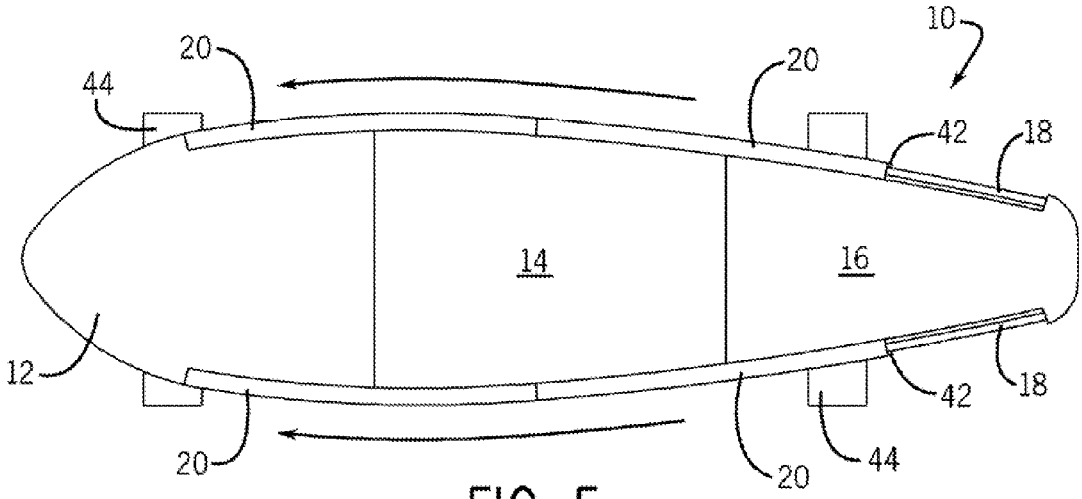
FIG. 5 is a top view of an assembled skateboard illustrating the rails in an assembled and locked position.
Figure 6:
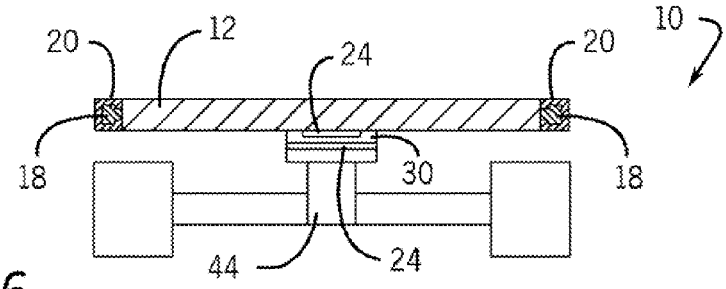
FIG. 6 is a cross-sectional view of the skateboard taken along the line 6-6 of FIG. 4.

The hinged Z-shaped deck can lock into a secure and rigid state in the following manner. As illustrated in FIG. 4 and FIG. 5, inner-rails 18 may be placed along the outside edges of the board pieces 12, 14, and 16 that may measure about ⅝" wide and ⅜" thick. The inner-rails 18 may be made from aluminum in some embodiments. A shallow channel, e.g., 1/16" deep and ⅛" wide may be formed along these inner-rails 18, which can be screwed in place. Two pairs of outer-rails 20 can be mounted onto the inner-rails 18 of the middle 14 and rear 16 board pieces. These outer-rails 20 can be made from ½" steel square tubing with an inside diameter of ⅜", for example. Along one side of the entire length of the outer-rail 20, a ¼" wide slot may be cut to create a C-shaped cross section that can enable the outer-rails 20 to slide smoothly over the inner-rails 18.

With one hand holding the front board piece 12 and the other hand gripping the outer-rail 20 of the rear board piece 16, the Z-shaped folded deck can be quickly unfolded to a flat 45" deck. The hand gripping the rear outer-rail 20 can now slide forward which can simultaneously push the outer-rail 20 of the middle board piece 14 towards the front board piece 12 as illustrated in FIG. 5. The outer-rails 20 can travel about 7½" over the board pieces. The rear board piece's 16 outer-rail 20 can slide about half-way over the inner-rail 18 of the middle board piece 14, and the outer-rail of the middle board piece 14 can slide about half-way over the inner-rail 18 of the front board piece 12. The moment the outer-rails 20 complete their travel, a spring-loaded bullet catch may pop out of the inner-rail 18, locking the two outer rails 20 in place and forming a rigid flat longboard.

The flat longboard can be folded back to the Z-shaped tri-fold unit by reversing the folding operation. When the outer rails 20 are in position to allow the board 10 to fold, a set of four bullet catches (not illustrated) may be used to hold the outer rails 20 in place so they do no fall off when the board is in a folded configuration. For example, small dimples may be formed inside the outer rail that may be drilled deep enough for the heads of spring-loaded bullet catches to be secure, but shallow enough to allow the outer rails 20 to be pushed forward with a firm grip of the outer rail 20.

Figure 10:
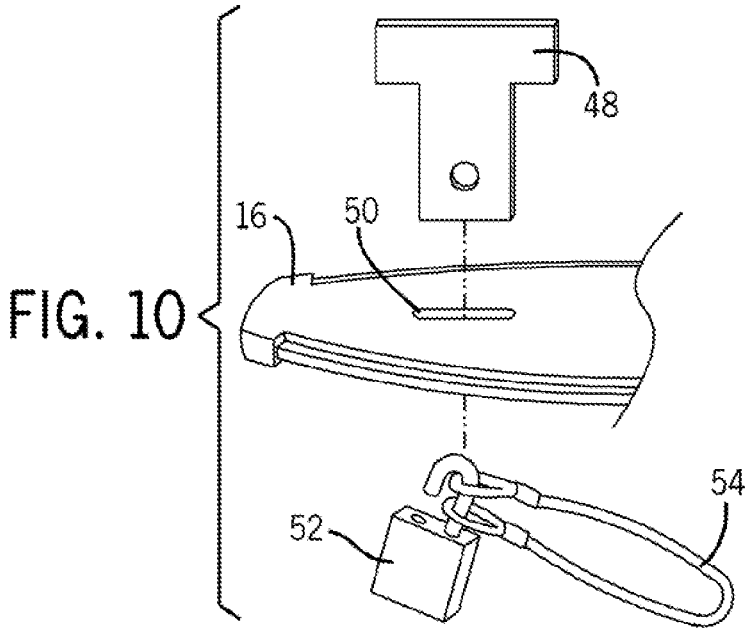
FIG. 10 illustrates one embodiment of a locking system for the skateboard.
Figure 11:
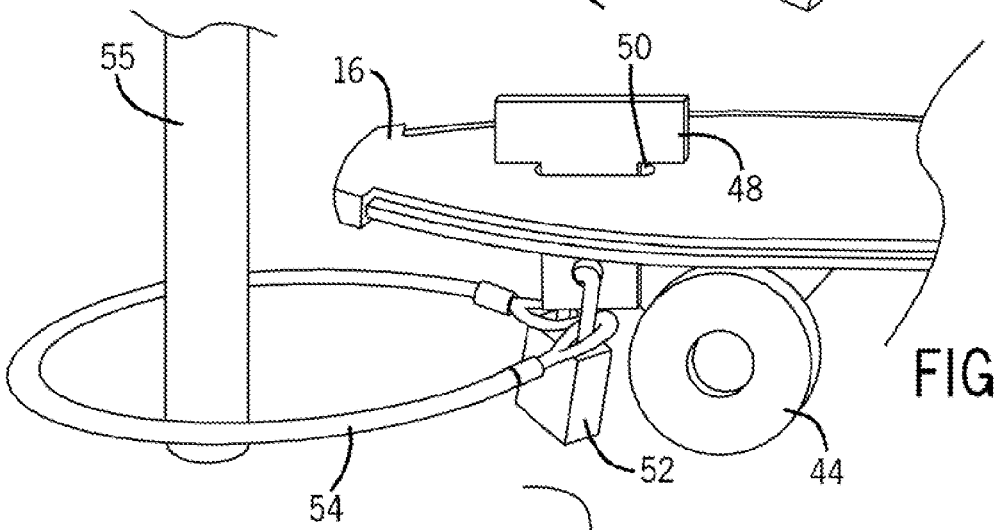
FIG. 11 illustrates use of the locking system illustrated in FIG. 10.
Figure 12:
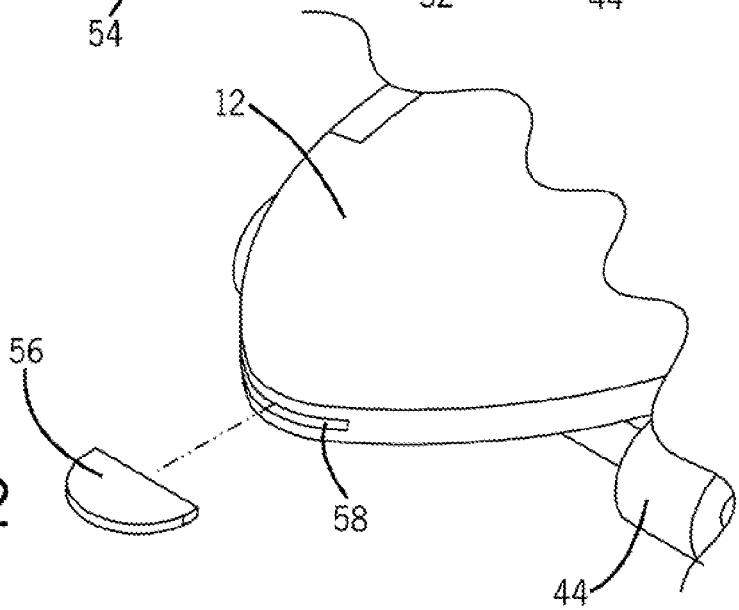
FIG. 12 illustrates a perspective view of one embodiment of a front bumper for a skateboard.
Figure 13:
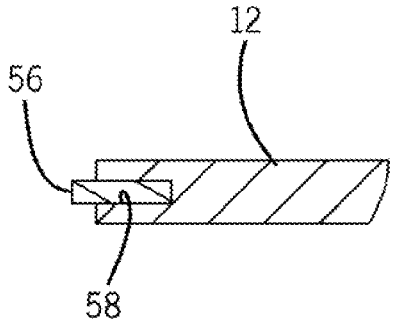
FIG. 13 is a cross-sectional view of the front bumper shown in FIG. 12.

As illustrated in FIG. 10-FIG. 11, some embodiments of the folding skateboard 10 may also include a key slot 50 in the rear board piece 16 to enable securing the skateboard to a post 55, for example. The key slot 50 may be used with a locking key 48 and a padlock 52 and lock cable 54 to lock the board to a post 55. Moreover, as illustrated in FIG. 12 some embodiments of the folding skateboard 10 may also include a bumper slot 58 in the front board piece 12 that may accommodate a bumper 56 to protect the nose of the folding skateboard 10. A cross sectional view of an installed bumper 56 is illustrated in FIG. 13.

Some embodiments of the folding skateboard 10 of the present invention may be made with a table saw, a drill press, and a router. Aluminum can be easily cut with metal cutting blades, drills, and router bits. The wheel-truck plates can be made with an aluminum cutting router blade, following a wooden jig pattern made to the proper specification. A computer numerical control (CNC) cutting machine can be used to cut the ¼" grooves in the stainless steel outer-rails. The board can initially be made in one solid 9×45" piece, shaped to a familiar skateboard outline, and then cut on table saw into 3 equal 15" lengths.

It should be understood, of course, that the foregoing relates to exemplary embodiments of the invention and that modifications may be made without departing from the spirit and scope of the invention as set forth in the following claims.

What is claimed is:

1. A skateboard comprising:

a board deck comprising a first board piece, a second board piece, and a third board piece;

a first hinge set connecting the first board piece to the second board piece; and a second hinge set connecting the second board piece to the third board piece, wherein, when in a folded position, the first board piece, the second board piece and the third board piece, are configured to form a hinged three-layered configuration with the second board piece disposed between the first board piece and the third board piece.

2. The skateboard of claim 1, further comprising:

a first deck shoe disposed on the first board piece;

a second deck shoe disposed on the third board piece; and a first truck shoe disposed on a first truck; and a second truck shoe disposed a second truck, wherein the first truck shoe can slide onto the first deck shoe and be locked in place, and the second truck shoe can slide onto the second deck shoe and be locked in place.

3. The skateboard of claim 2, wherein the first and second deck shoes and the first and second truck shoes are machined from a solid piece of material.

4. A skateboard comprising:

a board deck comprising a first board piece, a second board piece, and a third board piece;

a first hinge set connecting the first board piece to the second board piece;

a second hinge set connecting the second board piece to the third board piece, a first deck shoe disposed on the first board piece;

a second deck shoe disposed on the third board piece;

a first truck shoe disposed on a first truck; and a second truck shoe disposed a second truck, wherein the first truck shoe can slide onto the first deck shoe and be locked in place, and the second truck shoe can slide onto the second deck shoe and be locked in place, and wherein the first and second truck shoes are comprised of a upper truck plate, a middle truck plate and a lower truck plate, and the first and second deck shoes are comprised of an upper deck plate and a lower deck plate.

5. The skateboard of claim 2, further comprising at least one bullet catch located at an open end of the first and second deck shoe, wherein the first and second truck shoes are secured to the deck shoe by the bullet catches.

6. The skateboard of claim 1, further comprising:

a bumper slot in the first board piece; and a bumper, wherein the bumper is secured to the bumper slot.

7. A skateboard comprising:

a board deck comprising a first board piece, a second board piece, and a third board piece;

a first hinge set connecting the first board piece to the second board piece;

a second hinge set connecting the second board piece to the third board piece;

a key slot in the third board piece; and a key, wherein the key includes a hole and is accommodated by the key slot to facilitate securing the board using a lock and cable.

* * * * *